US009224549B2

(12) United States Patent
Jensen et al.

(10) Patent No.: US 9,224,549 B2
(45) Date of Patent: Dec. 29, 2015

(54) ELECTRIC HAND CONTROL, ESPECIALLY FOR ELECTRICALLY ADJUSTABLE HOSPITAL AND CARE BEDS

(75) Inventors: Svend Erik Knudsen Jensen, Sønderborg (DK); Jesper Rørby Jensen, Sønderborg (DK); Verner Smidt, Broager (DK); Bjarne Carstensen, Augustenborg (DK)

(73) Assignee: Linak A/S (DK)

( * ) Notice: Subject to any disclaimer, the term of this patent is extended or adjusted under 35 U.S.C. 154(b) by 0 days.

(21) Appl. No.: 12/084,786

(22) PCT Filed: Nov. 10, 2006

(86) PCT No.: PCT/DK2006/000622

§ 371 (c)(1), (2), (4) Date: May 9, 2008

(87) PCT Pub. No.: WO2007/054096

PCT Pub. Date: May 18, 2007

(65) Prior Publication Data

US 2009/0095602 A1 Apr. 16, 2009

(30) Foreign Application Priority Data

Nov. 11, 2005 (DK) ..... 2005 01569

(51) Int. Cl.
*H01H 9/28* (2006.01)
*H01H 9/20* (2006.01)
(Continued)

(52) U.S. Cl.
CPC . *H01H 9/20* (2013.01); *H01H 3/08* (2013.01); *H01H 3/42* (2013.01); *H01H 9/0214* (2013.01); *A61G 7/018* (2013.01); *H01H 2300/024* (2013.01)

(58) Field of Classification Search
CPC ..... H01H 3/42; H01H 3/08; H01H 25/065; H01H 9/20; H01H 9/2014
USPC ..... 200/43.16, 518, 5 E, 43.08, 528, 336, 200/330, 332.2
See application file for complete search history.

(56) References Cited

U.S. PATENT DOCUMENTS 1,842,451 A * 1/1932 Jacobi ..... 200/43.08
4,425,673 A 1/1984 Werner
(Continued)

FOREIGN PATENT DOCUMENTS

CH 681833 5/1993
CH 691638 8/2001
(Continued)

OTHER PUBLICATIONS

English Abstract of CH681833.
(Continued)

*Primary Examiner* — Felix O Figueroa
(74) *Attorney, Agent, or Firm* — Dykema Gossett PLLC

(57) ABSTRACT

An electric hand control, especially for electrically adjustable hospital and care beds comprising a number of activation switches and a number of locking switches which can be activated by a locking element for cutting off the circuit for the activation switches so that the function belonging to it becomes inactive or locked. In an embodiment the locking switches are on-off switches, in another embodiment the locking switches are based on a read switch and a magnet, and in another embodiment the locking switches include a wave shaped disc mounted over two contact points.

10 Claims, 2 Drawing Sheets

(51) Int. Cl.

| | |
|---|---|
| ***H01H 3/42*** | (2006.01) |
| ***H01H 3/08*** | (2006.01) |
| ***H01H 9/02*** | (2006.01) |
| *A61G 7/018* | (2006.01) |

(56) References Cited

U.S. PATENT DOCUMENTS

| | | | | |
|---|---|---|---|---|
| 5,205,004 | A | 4/1993 | Hayes et al. | |
| 6,674,025 | B1 * | 1/2004 | Marchant | 200/42.01 |

FOREIGN PATENT DOCUMENTS

| | | |
|---|---|---|
| DE | 9413248 | 1/1995 |
| DE | 9414086 | 11/2004 |
| DE | 102005031820 | 3/2006 |
| WO | WO2005036576 | 4/2005 |

OTHER PUBLICATIONS

English Abstract of DE102005031820.

* cited by examiner

ELECTRIC HAND CONTROL, ESPECIALLY FOR ELECTRICALLY ADJUSTABLE HOSPITAL AND CARE BEDS

BACKGROUND OF THE INVENTION

1. Field of the Invention

The present invention relates to an electric hand control especially for electrically adjustable hospital and care beds.

2. The Prior Art

As examples of adjustable hospital beds, EP 0 488 552 A1 Huntleigh Technology plc and U.S. Pat. No. 4,425,673 B-W Health Products, Inc. can be mentioned. Typically, there are two controls for the bed, a hand control with which the patient can adjust the bed to the wanted position and a control panel at the end of the bed where the hospital staff can make adjustments of the bed, among these, adjustment in excess of the adjustments possibilities of the patient. At the same time, the staff can block medical positions that are not allowed for the patient in question, so that the patient cannot inadvertently activate a position not allowed. For instance, raising the leg section by a patient who has a thigh bone fracture.

Instead of a separate hand control and control panel, it can be desirable to have only the hand control. For care beds which typically are not as technically advanced as hospital beds and which are only equipped with a hand control, it can also be expedient to have a blocking of certain adjustment functions.

In CH 681 833 Magnetic Elektromotoren AG a hand control for hospital beds with a blocking arrangement for various functions is mentioned. The control is a pneumatic control, and the keys are placed in pairs with one key for activation of the function and the other for reversing to the initial position. The blocking arrangement works strictly mechanically with a pin with two wings placed between two sets of contacts. By turning the pin with a key for that purpose, the two wings can be brought under a flange on the keys and block the pressing of the keys. In an electric hand control from the same company described in CH 691 638 Magnetic Elektromotoren AG the keys are blocked completely electronically. For this purpose the hand control contains two read-switches, which can be activated with a key comprising two magnets, one for each of the two read-switches. When the read-switch is activated, the control goes into programming mode, where the control can be programmed into locking and unlocking the operation keys.

The invention concerns hand controls where small square brick shaped switches with a pushbutton on the top side can be used, the switches being "Tactile Switches" or "Tact Switches". The switches are placed under a springy tongue in the top side of the hand control, on which a foil with graphics localizing the key and its function is mounted. By pressing the foil the tongue is pressed inwards and affects the pushbutton on the switch. The migration on the pushbutton is very modest, that is in the same size as the tolerance on the subjects, which makes a mechanical locking difficult. This is also reflected in the known technology mentioned above, where a mechanical solution is chosen for the pneumatic hand control and an electrical solution for the electric hand control.

The object of the invention is to provide an electric hand control with electric locking of the keys.

SUMMARY OF THE INVENTION

The hand control is characterized in that it includes a number of locking switches which can be activated by means of the locking element, by which means the circuit for the activation switches is cut off. By cutting off the circuit for the activation switches, these are made inactive and can therefore not set off a function even though they are operated. By traditionally placing the keys in pairs, it is possible to cut off the circuit for both keys with only one locking switch, and the locking element can also be mounted between the two keys, so that the layout of the hand control compared to known hand controls can be preserved.

In an embodiment locking switches with an axially moveable operation element are used, and the locking element is rotatable about its axis and has a knob, which activates the locking switch when the locking element is turned. Such a locking switch has the advantage, that it is actively forced to a power cut and problems with a sticking switch are thereby avoided.

In another embodiment the locking switches are read-switches. The locking element is also here rotatable about its axis and includes a magnet which activates the read-switch for cutting off the circuit for the activation switch when the locking element is turned. Unlike the construction in CH 691 638 , no programming is needed the circuit for the activation switch can simply be cut off.

In yet another embodiment the locking switches have a wave shaped disc mounted over two contact points in the circuit for the activation switch and which cut off the circuit for this purpose when the locking element is turned. In a position the wave shaped disc rests on the two contact points with a wave top and in another position the wave disc straddles over the two contact points with a wave through and the circuit for the activation switch is thereby cut off.

Characteristic for all the embodiments is that they cannot be broken as a result of over rotation, as the locking element can be turned freely. In the locking position where the activation switch is locked, the locking element is meshing with a latch mechanism.

To indicate whether the keys are locked or unlocked the locking element can be equipped with an indicator, which when displaced is brought to a window, visible on the front of the hand control. In a simple way it can be a red marking, which is brought to the window, so that it becomes visible in the locking position through a transparent field in the cover foil.

Further features of the invention will be explained more fully below in connection with an embodiment of the invention with reference to the accompanying drawings.

DETAILED DESCRIPTION OF THE PREFERRED EMBODIMENTS

Figure 1:
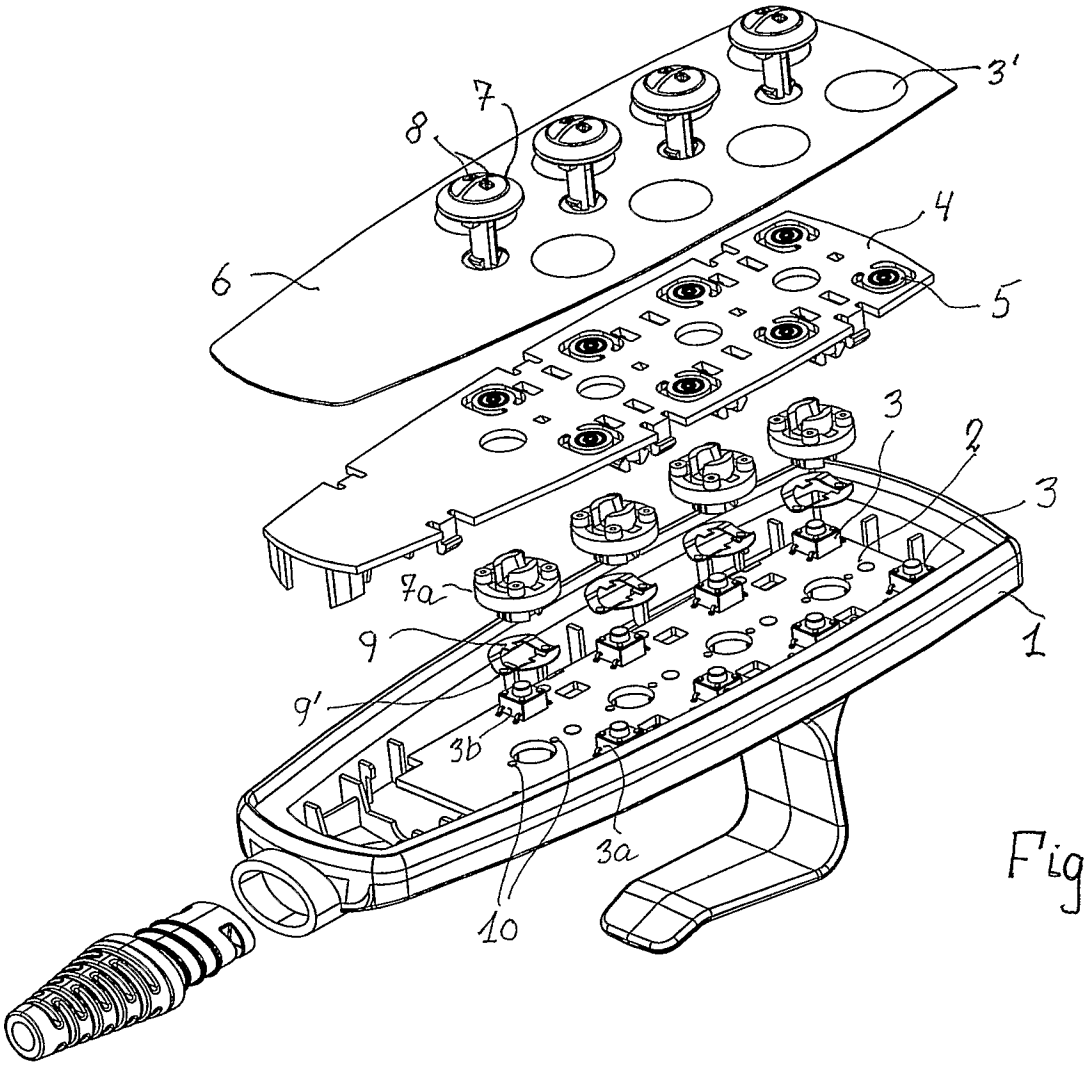
FIG. 1 shows an exploded view of a first embodiment of the hand control according to the invention.

The embodiment deals with a hand control for electrically adjustable care and hospital beds with actuators for raising and lowering an back rest and leg rest and also raising and lowering the bed as a whole. For this purpose the hand control is equipped with keys placed in pairs, where one key brings about the raising and the other one the lowering.

The hand control comprises a cup-shaped housing 1 of plastic, wherein a printed circuit 2 with two rows of activation switches 3 in the form of tactile switches is mounted, and above is a plate 4 with tongue-like keys 5. The topside of the housing is equipped with a cover foil 6 with graphics 3' localizing the keys and their function. The hand control has a locking function for the activation switches 3, where the locking is done with knobs 7 which are rotatable about their axis. The turning can be done with a special key with two knots, which can be brought into mesh with the two holes 8 on the top side of the keys.

In a first embodiment the locking switch, which operates a few keys, is based on an electric conductive wave-shaped ring 9 mounted on a lower part 7*a* of the turning knob 7. The tops 9' on the wave-shaped ring 9 can be brought into contact with a couple of contact points 10 on the printed circuit 2 by turning the knob 7, which causes the circuit for the two adjacent activation switches 3*a*,3*b* to be closed and said adjacent activation switches are then operational. By turning the knob 7 the wave tops 9' can be brought out of contact with the contact points 10 so that the wave-shaped ring 9 straddle over the contact points with the wave through. The circuit for the activation switches 3*a*, 3*b* are then cut off and the activation switches are inactive. The function in the bed controlled by it is thereby locked, i.e., it cannot be activated before the knob is turned again so that the circuit for the activation switches 3*a*, 3*b* is once more closed. Whether the keys, or more precisely the activation switches, are locked or workable appears from an indication on the top side of the knob 7. In the lower part of the knob 7*a* there can be a latch mechanism, so that a perceptible click can be felt when the key is in the active position, or for that matter in the locked position, but in this position the key will anyhow feel loose as the wave-shaped ring is free from its contact points.

Here is shown a locking function for all the keys, but it is understood that a locking function for selected keys is possible, for instance so that only the back rest and the foot rest in a bed can be locked whereas the keys for raising and lowering the bed cannot be locked.

Figure 2:
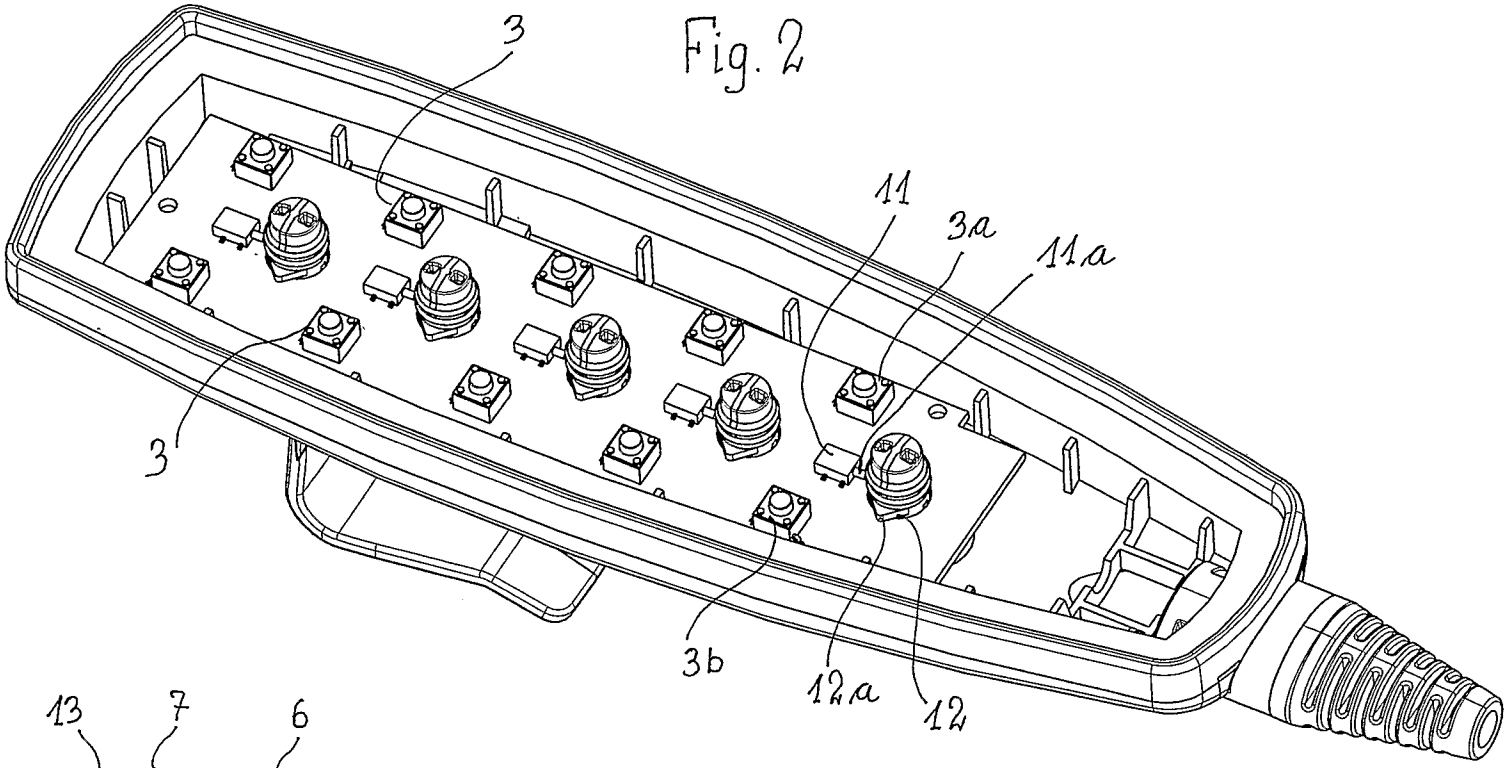
FIG. 2 shows the housing of the hand control with printed circuit in a second embodiment of the hand control according to then invention.

In FIG. 2 of the drawing another embodiment for the invention is shown, where the locking function is based on a locking switch in the form of a on/off switch 11, which when activated is brought to cut off the circuit for the two adjacent activation switches 3*a*, 3*b*. Here the lower part of turning knob 7 has two opposite knots 12, with a small notch 12*a* in the outer end as a latch mechanism. By turning the knob 7 the wing is brought in abutment with the activation element 11*a* of the locking switches and presses it inwards until it rests in the notch 12*a* in the outer end of the knot. When the on/off switch 12 is activated the circuit for the activation switches 3*a*, 3*b* and the related function in the bed become inactive.

Figure 3:
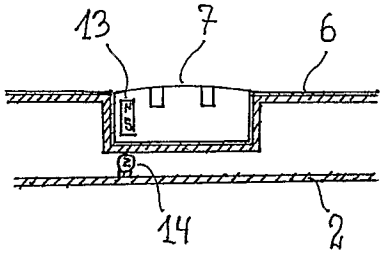
FIG. 3 shows a cross section through a turning knob in a third embodiment of the hand control according to the invention.

In FIG. 3 of the drawing another solution is mentioned, where the locking switch is based on a magnet 13 embedded in the turning knob 7 and a read-switch 14 mounted on a printed circuit 2. By turning the knob 7 so that the magnet is brought in a position above the read-switch the read-switch for cutting off the circuit for the activation keys 3*a*, 3*b* is activated. When the magnet 13 is turned away from the read-switch, the read-switch falls back and the circuit for the activation switches is reestablished.

Characteristic for all three embodiments is that the knob 7 cannot be over rotated in a mechanical end stop and break as a result. The knob can be turned all the way around and assume the two positions of locked and unlocked.

The invention claimed is:

1. A hand-held controller which comprises:

a cup-shaped housing, a circuit board mounted in the housing, at least a pair of activation switches comprising first and second activation switches mounted on the circuit board, a separate electrical circuit connecting the activation switches of said pair of activation switches wherein opening and closing of said first activation switch of said pair of activation switches, when activated, is configured to communicate a first function and opening and closing of the second activation switch of said pair of activation switches, when activated, is configured to communicate a second function that is different from and independent of said first function, and a separate controller means for completing or interrupting said separate electrical circuit and thereby activating or deactivating said pair of activation switches in the associated electrical circuit, each controller means comprising an on-off switch connected in the respective electrical circuit and a separate rotatable knob for operating each on-off switch, wherein said on-off switch is arranged relative to said pair of activation switches such that when said on-off switch is positioned to complete said separate electrical circuit the opening and closing of the first activation switch of said pair of activation switches communicates said first function and the opening and closing of the second activation switch of said pair of activation switches communicates said second function, and wherein each of the on-off switches has an axially movable activation element and each knob is rotatable about its axis and has a knot with a surface that rotates when said knob rotates, and wherein when the knob is rotated, said surface of said knot engages said activation element of said on-off switch depressing said activation element axially inwardly to activate the on-off switch for cutting off the circuit for the activation switch.

2. The hand-held controller according to claim 1, wherein each said on-off switch includes a respective activation element and each rotatable knob includes a respective knot which can operate a respective activation element when a one of said knobs is rotated.

3. The hand-held controller according to claim 1, wherein when said knob is rotated, said surface of said knot engages said activation element depressing said activation element axially inwardly until said activation element rests in a notch disposed at an outer end of said knot.

4. An electric controller comprising:

a plurality of electric activation switches placed in respective pairs in a control circuit, for each pair comprising respective first and second electric activation switches:

wherein opening and closing of said first electric activation switch of said pair of electric activation switches, when activated, is configured to communicate a first function and opening and closing of said second electric activation switch of said pair of electric activation switches, when activated, is configured to communicate a second function that is different from and independent of said first function, a plurality of locking switches in the control circuit, one locking switch being associated with a pair of electric activation switches, and a plurality of locking elements, one locking element being associated with a locking switch, said locking elements being shiftable from a parked position to a locking position, such that when in the locking position activates a locking switch by which means the circuit for the associated pair of activation switches is cut off, and wherein one of the locking switches is arranged relative to the associated pair of electric activation switches such that the opening and closing of said first electric activation switch of said pair of electric activation switches communicates said first function and the opening and closing of said second electric activation switch of said pair of electric activation switches communicates said second function, and wherein each of the locking switches has an axially movable operation element and each locking element is rotatable about its axis and has a knot with a surface, said knot rotates when said locking element rotates, and wherein when said locking element is rotated, said surface of said knot engages said operation element of said locking switch depressing said operation element axially inwardly to activate the locking switch for cutting off the circuit for the activation switch.

5. The hand controller according to claim 4, wherein each locking element includes two knots located opposite one another.

6. The hand controller according to claim 4, wherein the knot includes a notch at an outer end thereof, and wherein when said locking element is rotated, said surface of said knot engages said operation element of said locking switch depressing said operation element axially inwardly until said operation element rests in said to thereby activate the locking switch for cutting off the circuit for the activation switch.

7. The hand controller according to claim 4, wherein one of the locking switches is an on-off switch.

8. The hand controller according to claim 4, wherein each of the locking elements includes two holes for receiving a turning key.

9. An electrically adjustable care or hospital bed having at least one adjustable section and equipped with at least one actuator for operating the adjustable section, and an electric controller for controlling the actuator, said electric controller comprising:

a plurality of electric activation switches placed in respective pairs in a control circuit, at least one pair of said activation switches comprising first and second activation switches controlling the at least one actuator, wherein for said at least one pair of said activation switches:

opening and closing of said first activation switch of said at least one pair of activation switches, when activated, being configured to communicate a first function for control of said at least one actuator and opening and closing of said second activation switch of said pair of activation switches, when activated, being configured to communicate a second function that is different from and independent of said first function for control of said at least one actuator, a plurality of locking switches in the control circuit, one locking switch being associated with a pair of electric activation switches, and a plurality of locking elements, one locking element being associated with a locking switch, said locking elements being shiftable from a parked position to a locking position, such that when in the locking position it activates a locking switch by which means the circuit for the associated pair of activation switches is cut off and thereby prevents adjustment of the related adjustable section, and wherein one of the locking switches is arranged relative to the associated pair of electric activation switches such that the opening and closing of said first electric activation switch of said pair of electric activation switches communicates said first function and the opening and closing of said second electric activation switch of said pair of electric activation switches communicates said second function, and wherein each of the locking switches has an axially movable operation element and each locking element is rotatable about its axis and has a knot with a surface, said knot rotates when said locking element rotates, and wherein when said locking element is rotated, said surface of said knot engages said operation element of said locking switch depressing said operation element axially inwardly to activate the locking switch for cutting off the circuit for the activation switch.

10. The electric controller according to claim 9 wherein when said locking element is rotated, said surface of said knot engages said operation element depressing said operation element axially inwardly until said operation element rests in a notch disposed at an outer end of said knot.

* * * * *